US006092390A

United States Patent [19]

Griffith, Jr.

[11] Patent Number: 6,092,390

[45] Date of Patent: Jul. 25, 2000

[54] PORTABLE, AUTOMATIC, OIL RECOVERY SYSTEM

[76] Inventor: David R. Griffith, Jr., Rt. #1, Box 583, Hortense, Ga. 31543

[21] Appl. No.: 09/002,448

[22] Filed: Jan. 2, 1998

[51] Int. Cl.[7] ..... F25B 45/00

[52] U.S. Cl. ..... 62/468; 62/77; 62/84; 184/1.5

[58] Field of Search ..... 62/468, 84, 77; 184/1.5

[56] References Cited

U.S. PATENT DOCUMENTS

| | | | |
|---|---|---|---|
| 3,225,554 | 12/1965 | Alexander | 62/77 |
| 4,311,023 | 1/1982 | Watral | 62/468 |
| 4,364,236 | 12/1982 | Lower et al. | 62/77 |
| 4,428,208 | 1/1984 | Krause | 62/192 |
| 5,226,300 | 7/1993 | Christensen et al. | 62/77 |
| 5,321,956 | 6/1994 | Kemp et al. | 62/193 |
| 5,325,675 | 7/1994 | Manz | 62/77 |
| 5,361,594 | 11/1994 | Young | 62/129 |
| 5,445,505 | 8/1995 | Hung | 417/374 |
| 5,450,924 | 9/1995 | Tseng | 184/1.5 |
| 5,460,005 | 10/1995 | Eden | 62/125 |
| 5,685,331 | 11/1997 | Westermeyer | 137/426 |

*Primary Examiner*—Henry Bennett
*Assistant Examiner*—Melvin Jones

[57] ABSTRACT

A compressor oil recovery device for use in removing oil from compressors typically found on condensing units used in air conditioning or refrigeration applications is disclosed. The device consists of a canister with a lid that contains a vacuum port, a suction port, a drain port, and a vacuum release port. A vacuum hose is connected at one end to the vacuum port and at the other end to an electric vacuum pump. A suction hose is connected at one end to the suction port and at the other end to the gauge manifold of a compressor. Upon activating the vacuum pump, a vacuum is created that draws the compressor oil into the canister where it is collected for disposal.

11 Claims, 6 Drawing Sheets

PORTABLE, AUTOMATIC, OIL RECOVERY SYSTEM

BACKGROUND OF THE INVENTION

1. Field of the Invention

The present invention relates generally to oil recovery systems and, more particularly, to a portable, automatic, oil recovery system for removing oil from a compressor, of the type typically found in refrigeration or air conditioning units, which is to be repaired or retrofitted with new refrigerant.

2. Description of the Related Art

It is well known that the removal of oil from compressors can be a difficult, time consuming, and many times messy task. The difficulty of this task is increased due to the fact that many compressors do not have a drain port for the removal of oil.

In the ancillary art, there are several large oil recovery devices, such as that disclosed in U.S. Pat. No. 5,321,956, issued in the name of Kemp et al. The '956 device discloses a large compressor oil management and separation system, comprising a large main oil storage tank, a pump, valves and remote control means for selectively directing oil from the tank to any one or more of several compressors.

There are drawbacks associated with the '956 device, however. In addition to being complex and expensive, such a device is one of sufficient bulk, size and weight as to be impractical for use as a portable device.

With respect to portable oil recovery devices, the previous art is limited. U.S. Pat. No. 5,450,924, issued in the name of Tseng et al., discloses a portable oil suction device consisting of a solid oil tank, a pump cylinder inside the tank, and a plunger moved in the pump cylinder to create a suction force for drawing engine oil from an automobile engine.

This device, however, has several problems associated with it. First, it is designed for engine oil removal, with connectors designed for that purpose. The fittings are not easily adaptable to the standard 0.25 inch diameter oil drainage holes found on compressors. Second, the '924 device's plunger assembly requires significant effort on the part of the user to manually pump the oil. Third, using the plunger is made more difficult when work space is limited. Fourth, the plunger device is difficult to use when circumstances necessitate its use at odd angles, such as leaning over a car engine or bending down to drain a compressor. Fifth, once the oil is removed, the user must carry the entire device along with the oil to the designated oil storage place. This added weight resulting from the nondetachable nature of the oil storage compartment means creates strain on the arms and back, and could result in injury. Sixth, disassembly of the storage device from the main unit is complex and time consuming. Seventh, the '924 device does not facilitate easy connection to oil drainage holes located in hard to reach places or holes positioned at odd angles to the oil suction device.

Another oil removal system is disclosed in U.S. Pat. No. 5,445,505, issued in the name of Hung et al. The '505 device discloses an oil pump that is operated either manually, pneumatically or hydraulically. When operated in manual mode, a lever is used, which is connected at one end to a plunger which extends into a valve chamber. The lever is used to actuate the pump plunger. Manual operation of the '505 device creates the numerous problems discussed above that are associated with the '924 device.

Operating the '505 device in automatic mode creates other problems. First, the device requires connection to high pressure hoses and hydraulic equipment to operate properly. This eliminates the portable nature of the device, as the hydraulic equipment is usually heavy and burdensome to move from job site to job site. Second, the device has numerous operating parts, such as check valves, relief valves, plunger, and high pressure hoses used with hydraulic equipment. This increases the likelihood of component failure. Third, the device is expensive.

A search of the previous art did not disclose any patents that read directly on the claims of the instant invention. Consequently, a need has been felt for providing an oil removal system that overcomes the problems cited above.

SUMMARY OF THE INVENTION

It is therefore an object of the present invention to provide an improved oil removal system for compressors that is lightweight, inexpensive, completely portable and which facilitates quick, easy and convenient oil recovery and disposal.

Briefly described according to a preferred embodiment, the present invention consists of three lengths of hosing and a hermetically sealed canister with suction and vacuum ports on the lid thereof. Using couplings and connectors, such as 0.25 inch flare-type threaded fittings, the invention is connected in series between an electrically powered vacuum pump and a compressor.

In the preferred embodiment of the present invention, the first piece of hose is connected to the gauge manifold of the compressor using 0.25 inch flare-type threaded fittings. The hoses are color coded to facilitate ease of installation. The present invention is specifically designed to account for the fact that the holes in the gauge manifold are a standard 0.25 inch diameter opening. Using a coupling and a fitting such as a standard 0.25 inch flare-type threaded variety, the second length of hose connects the first length of hose to the suction port of the oil recovery canister. Finally, a third hose connects the vacuum pump to the vacuum port of the canister lid.

The oil recovery canister holds the recovered oil. It is of a single chamber design with a float valve built into the vacuum port so as to avoid spillage and prevent oil from overflowing into the vacuum pump. The canister is composed of a strong, lightweight material, such as plastic or metal. In the preferred embodiment, the vacuum pump is battery powered, thus making the present invention completely independent of external power sources, and thus completely portable.

When the pump is activated, a vacuum is created within the compressor oil recovery system and, as a result, oil is drawn from the compressor and deposited in the oil recovery canister for easy disposal.

In an alternate embodiment of the present invention, the electrical pump is powered via an electrical outlet, thus making it ideal for pumping large amounts of oil or pumping oil when there are nearby outlets.

Therefore, it is an object of the present invention to provide a compressor oil recovery system that is quick, easy and convenient to use by utilizing 0.25 inch flair-type threaded fittings. This allows the service technician to connect the compressor to the oil recovery canister and electrical pump quickly and easily, using the same tool, and thus producing several benefits. First, the service technician does not need additional tools to install and use the present invention, eliminating the time and effort of finding or carrying additional tools. Second, since the service technician is using familiar equipment, oil recovery time will be shortened.

Furthermore, it is an object of the present invention to provide a compressor oil recovery system that is quick, easy and convenient to use by utilizing an electrical pump, thus eliminating the burdensome labor associated with manual pump systems.

Furthermore, it is an object of the present invention to provide a compressor oil recovery system that is quick, easy and convenient to use by utilizing a lightweight electrical pump. This allows that present invention to be carried easily to the job site.

Furthermore, it is an object of the present invention to provide a compressor oil recovery system that is quick, easy and convenient to use by utilizing a pump that is battery operated, which eliminates the need for external power and allows for a self-contained unit that can be used where no electrical outlets are available.

Furthermore, it is an object of the present invention to provide a compressor oil recovery system that is quick, easy and convenient to use by eliminating the need to utilize expensive, bulky hydraulic equipment to properly use the present invention.

Furthermore, it is an object of the present invention, in an alternate embodiment, to provide a compressor oil recovery system that is quick, easy and convenient to use by utilizing a portable electrical pump that uses power from a standard outlet. This feature allows the present invention to perform continuously for long periods of time, thus facilitating the removal of large quantities of oil in a relatively short period of time.

Furthermore, it is an object of the present invention to provide a compressor oil recovery system that is quick, easy and convenient to use by utilizing an oil recovery canister. In accordance with a preferred embodiment, the present invention incorporates a canister composed of a clear plastic, which allows the technician to identify when the canister is full. This reduces the messy and time-consuming effort needed to clean up oil spills resulting from overfilling of the recovery canister during the oil recovery process.

Furthermore, it is an object of the present invention to provide a compressor oil recovery system that is quick, easy and convenient to use by utilizing a detachable oil recovery canister, which facilitates the removal of oil from the compressor without having to move or carry the other parts of the recovery system.

Furthermore, it is an object of the present invention to provide a compressor oil recovery system that is quick, easy and convenient to use by utilizing a lightweight oil recovery canister, which facilitates the quick and simple movement of the recovered oil from the pumping location to a suitable, environmentally safe, storage area. Also, this feature, in combination with the lightweight electrical pump, makes the present invention easily portable to various job sites.

Furthermore, it is an object of the present invention to provide a compressor oil recovery system that is quick, easy and convenient to use by utilizing color coded -hosing to facilitate the quick and easy assembly of the present invention.

Furthermore, it is an object of the present invention to provide a compressor oil recovery system that is quick, easy and convenient to use by utilizing flexible hose, which allow it to be manipulated into tight spaces for connection to the compressor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Compressor Oil Recovery Device
11 Canister
12 Lid
13 Vacuum Port
14 Suction Port
15 Drain Plug
16 Vacuum Release Plug
17 Graduation Markings
20 Vacuum Hose
21 Suction Hose
22 Hose Fittings
23 Gauge Manifold Hose
30 Vacuum Pump
31 Electric Drive Motor
32 Pump Mechanism
33 Vacuum Connection
34 Carrying Handle
35 Leg Stands
40 Condensing Unit
41 Compressor
42 Gauge Manifold
43 Drain Fitting

DESCRIPTION OF THE PREFERRED EMBODIMENTS

In order to describe the complete relationship of the invention, it is essential that some description be given to the manner and practice of functional utility and description thereof. Accordingly, the best mode for carrying out the invention is presented in terms of its preferred embodiment, herein depicted within the figures.

1. Detailed Description of the Figures

Figure 1:
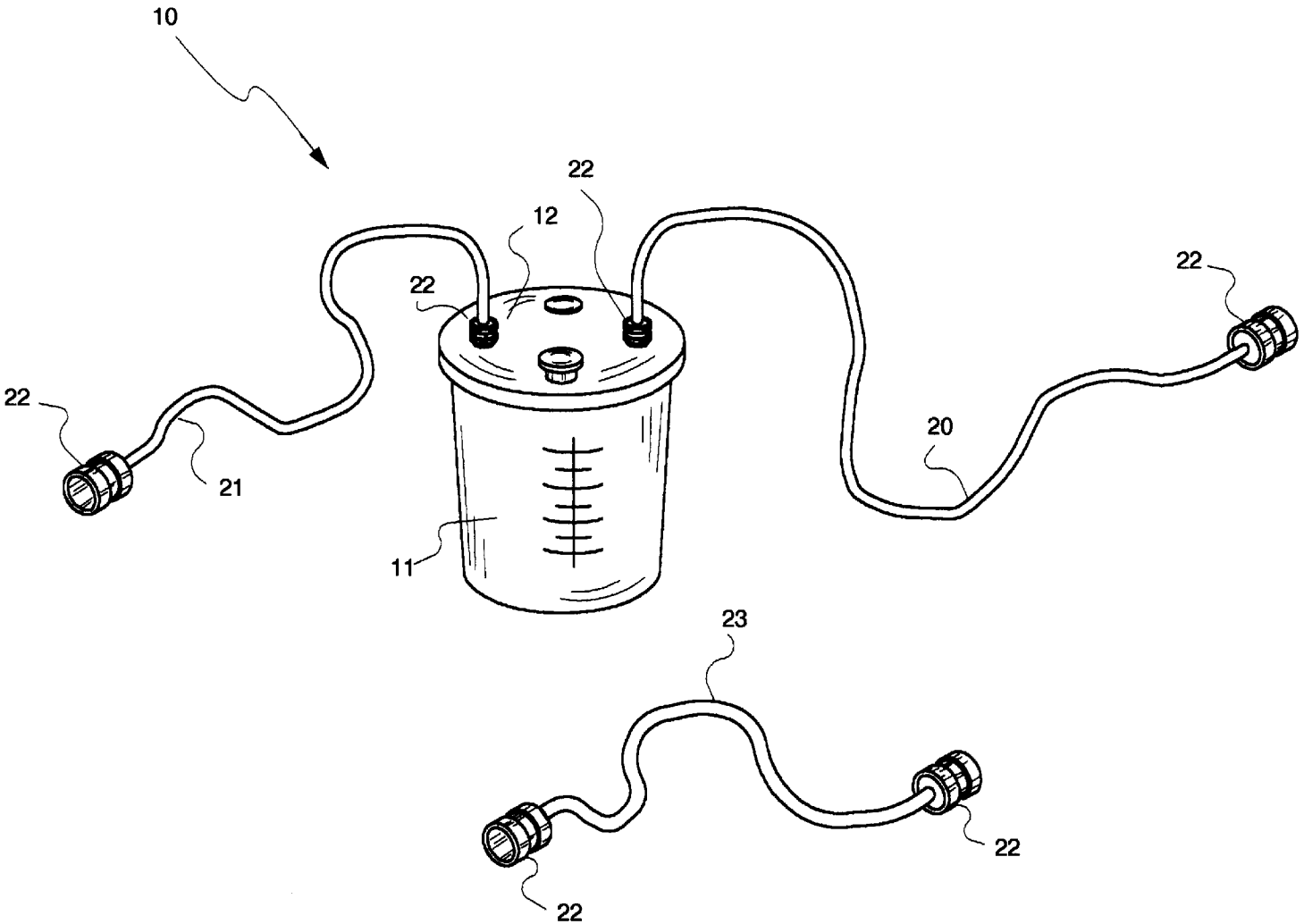
FIG. 1 is a perspective view of a portable, automatic oil recovery system according to the preferred embodiment of the present invention.
Figure 2:
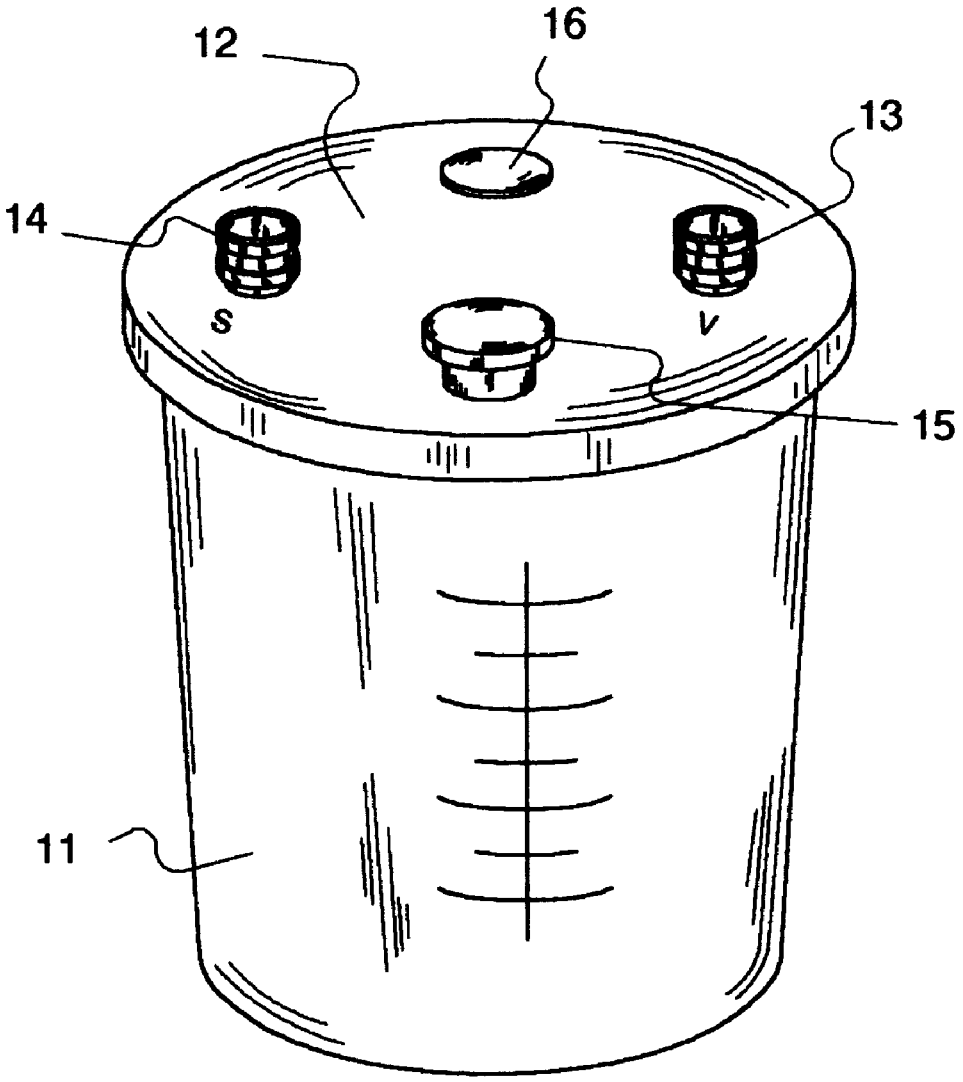
FIG. 2 is a detailed perspective view of the canister component according to the preferred embodiment of the present invention.
Figure 3:
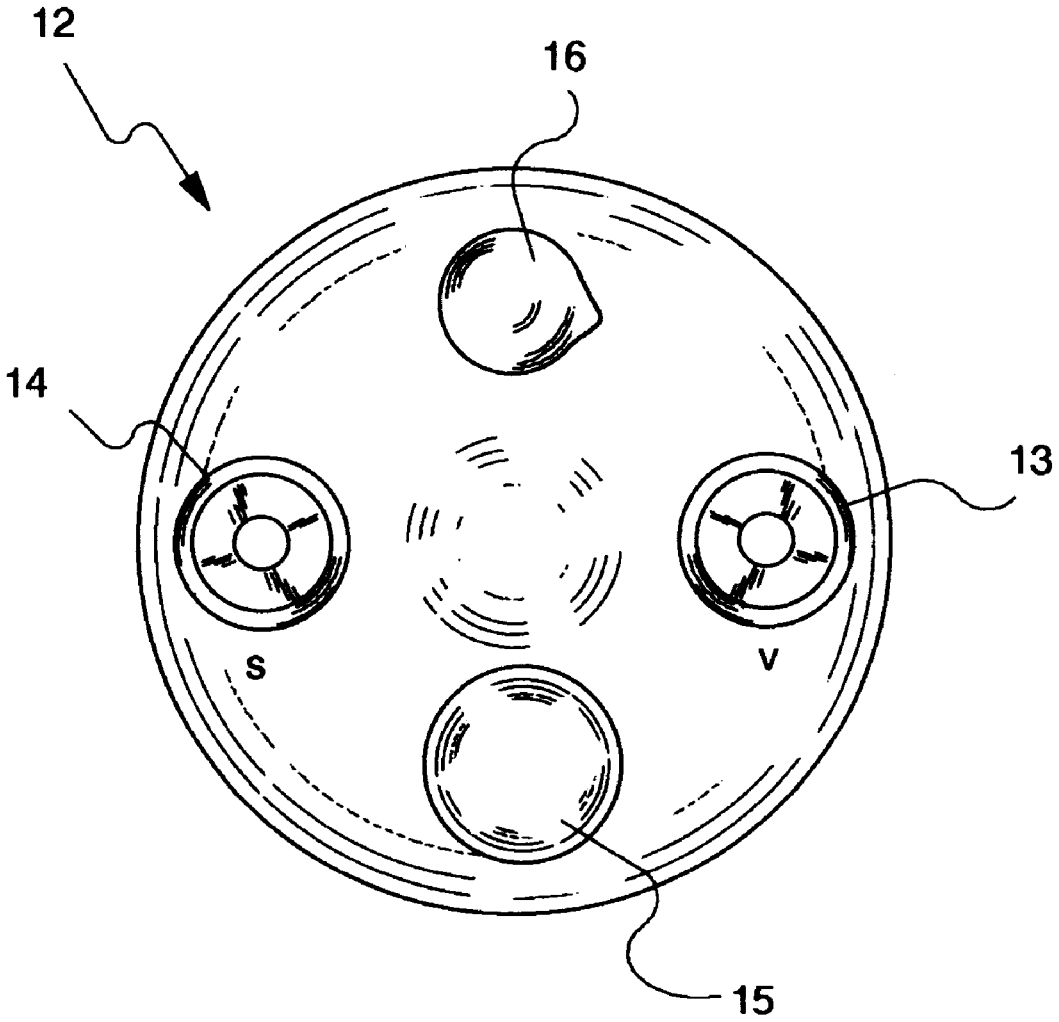
FIG. 3 is a side top view of the canister of FIG. 2.

Referring now to FIG. 1, FIG. 2 and FIG. 3, illustrated is a portable, automatic, compressor oil recovery device 10, according to the present invention, wherein a canister 11 is equipped with a lid 12. The canister 111 is generally cylindrical in shape having a disc-shaped base and a side wall extending vertically therefrom, forming a top rim and creating a hollow interior cavity. The lid 12 attaches to the canister 11 via friction fit compression fitting and forms a hermetic seal therewith. The lid 12 includes a vacuum port 13, a suction port 14, a drain plug 15 and a vacuum release plug 16, each of which consists of a conduit providing fluid communication with the interior volume of the canister 11. The vacuum port 13 and suction port 14 include a hose fittings such as a standard 0.25 inch threaded connector. The vacuum port 13 and suction port 14 are labeled with identifying indicia, such as a a "V" and "S," respectively, so as to provide an obvious indication to the user of the function of each port. According to the preferred embodiment, the canister 11 is constructed of a translucent material, such as plastic, and includes graduation markings 17 consisting of volumetrically delineating indicia along the oil recovery device 10 used to indicate the volume of the fluid contained therein.

A vacuum hose 20, approximately six to eight feet in length with first and second ends, is equipped with hose fittings 22 at both the first and second ends, designed for quick and easy connects and disconnects, such as a standard 0.25 inch flare-type threaded connector. The vacuum hose 20 is connected, at the first end, to the vacuum port 13 via a hose fitting 22, thereby creating a conduit providing fluid communication between the vacuum hose 20 and the interior cavity of the canister 11. A suction hose 21, approximately six to eight feet in length with first and second ends, is equipped with hose fittings 22 at both the first and second ends, designed for quick and easy connects and disconnects, such as a standard 0.25 inch flare-type threaded connector. The suction hose 21 is connected, at the first end, to the suction port 14 via a hose fitting 22, thereby creating a conduit providing fluid communication between the suction hose 21 and the interior cavity of the canister 11. Also included is a gauge manifold hose 23, approximately one to two feet in length with first and second ends, equipped with a hose fitting 22 at both the first and second ends, designed for quick and easy connects and disconnects, such as a standard 0.25 inch flare-type threaded connector. The vacuum hose 20, suction hose 21 and gauge manifold hose 23 are color-coded so as to simplify the assembly thereof.

Figure 4:
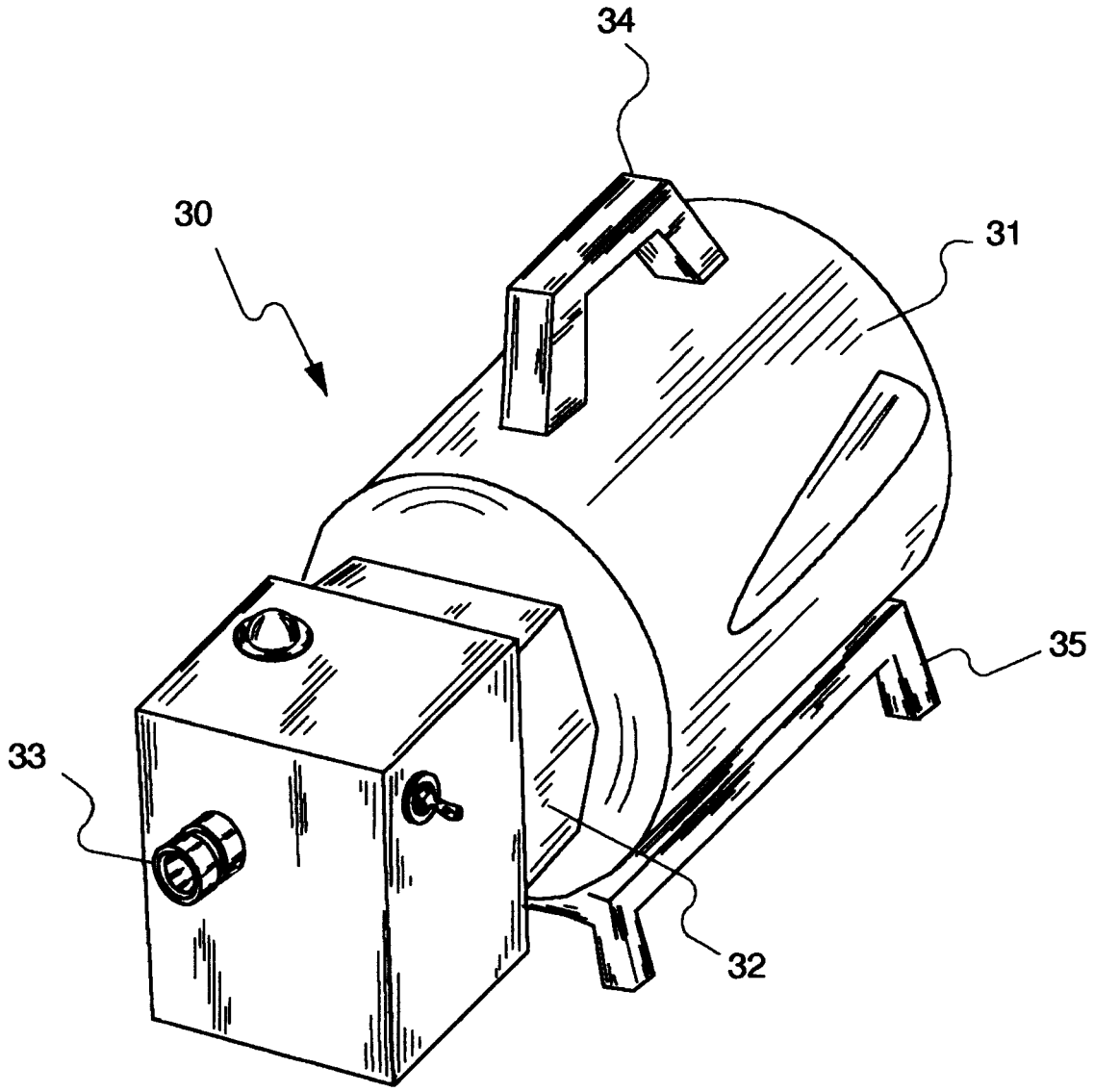
FIG. 4 is a perspective view of a vacuum pump for use with the present invention.

Referring to FIG. 4, illustrated is an electrically powered vacuum pump 30. The vacuum pump 30 consists of an electric drive motor 31 and a pump mechanism 32. On the preferred embodiment, the vacuum pump 30 is battery driven, making it portable in nature, although a unit requiring an AC outlet as a power source will suffice. A vacuum connection 33 provides a point at which to connect hoses or piping through which to draw a vacuum. The vacuum pump 30 is portable and includes a carrying handle 34 and leg stands 35.

Figure 5:
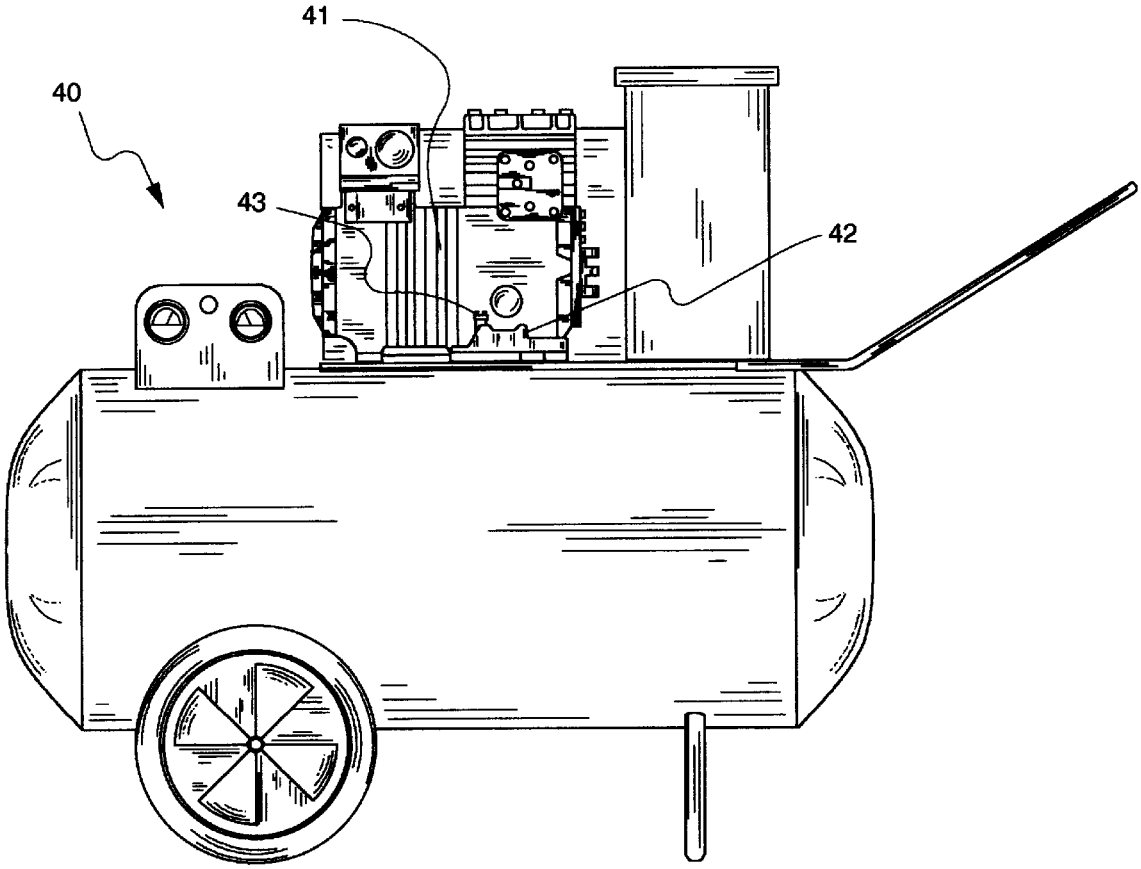
FIG. 5 is a front elevational view of a condensing unit and compressor therefor for use with the present invention.

Referring to FIG. 5, illustrated is a condensing unit 40. A compressor 41 is mounted upon the condensing unit 40. The compressor 41 is equipped with a gauge manifold 42 upon which the compressor oil reservoir drain fitting 43 is located. It is through the compressor oil reservoir drain fitting 43 that the compressor oil is filled and drained.

Figure 6:
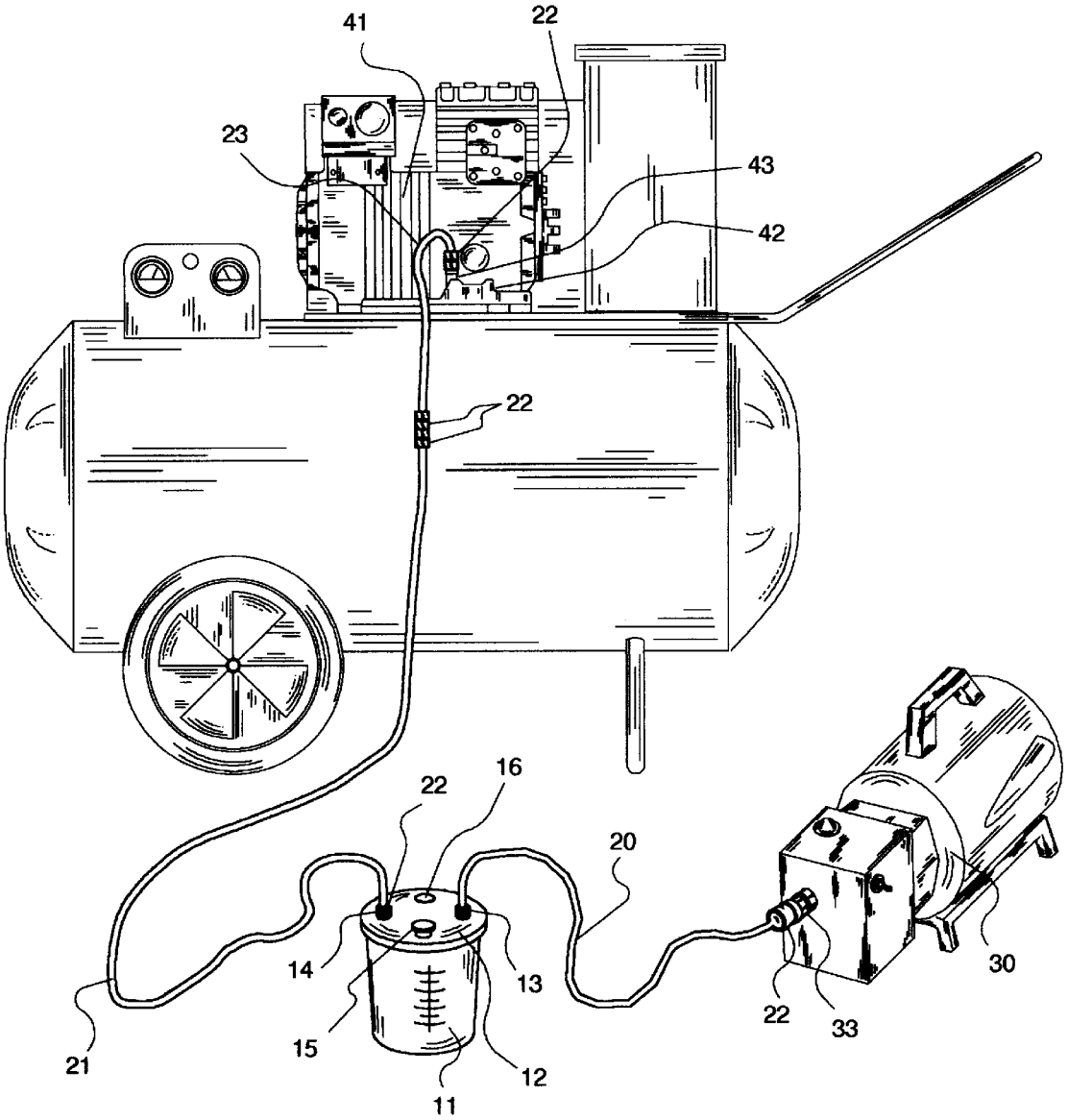
FIG. 6 is a perspective view showing a diagrammatical routing of fluid hose as used in conjunction with the preferred embodiment of the present invention.

Referring to FIG. 6, illustrated is the compressor oil recovery device 10 installed in series with a condensing unit 40 and a vacuum pump 30 in a configuration according to the preferred embodiment of the invention. As previously described, the canister 11 is fit with the lid 12, to which the first end of the vacuum hose 20 and the first end of the suction hose 21 are connected to the vacuum port 13 and suction port 14, respectively, via hose fittings 22. The first end of the gauge manifold hose 23 is connected to the gauge manifold 42 at the drain fitting 43 via a hose fitting 22. The drain fittings commonly found on compressors of this type are of a standard size, allowing the use of a standard threaded connector, in most cases one of a 0.25 inch diameter size. The second end of the gauge manifold hose 23 is connected to the second end of the suction hose 21 via hose fittings 22 such as a standard 0.25 inch flare-type threaded connector. The second end of the vacuum hose 20 is connected to the vacuum connection 33 of the vacuum pump 30 via hose fittings 22 such as a standard 0.25 inch threaded connector.

2. Operation of the Preferred Embodiment

In accordance with a preferred embodiment of the present invention, as shown in FIG. 6, the compressor oil recovery device 10 is used on the following manner:

The seals formed by the several hose fittings 22 and between the canister 11 and lid 12 are all air-tight. Upon activating the vacuum pump 30, a vacuum is drawn through the vacuum hose 20, in the sealed canister 11, through the suction hose 21, through the gauge manifold hose 23 and in the gauge manifold 42 through the drain fitting 43.. As a result, the compressor oil stored in the compressor 41 of the condensing unit 40 is drawn out of the gauge manifold 42 through the drain fitting 43, through the gauge manifold hose 23, through the suction hose 21 and into the canister 11. The compressor oil is thus drained in a quick and efficient manner, accumulating in the canister 11 for disposal. As the oil level in the canister 11 rises, it is prevented from being drawn through the vacuum hose 20 and into the vacuum pump 30 by a shut-off valve (not shown) consisting of a floating ball valve that isolates the vacuum hose 20 from the canister 11 when the oil therein reaches a dangerously high level.

When the compressor oil is completely drained from the compressor 41, or the oil within the canister 11 reaches the shut-off level, the user deactivates the vacuum pump 30 and disconnects the compressor oil recovery device 10 from the condensing unit 40. The vacuum hose 20 and suction hose 21 are disconnected from the vacuum port 13 and the suction port 14. The user then seals the vacuum port 13 and the suction port 14 with caps (not shown) such as a standard 0.25 inch threaded cap, thus sealing the compressor oil within the canister 11. In order to dispose of the compressor oil, the user removes the drain plug 15 and the vacuum release plug 16 from the lid 12, allowing the oil to be poured easily therefrom.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A compressor oil recovery device for use in removing oil from compressors typically found on condensing units used in air conditioning or refrigeration applications, said compressor oil recovery device comprising:

a canister, said canister having a generally cylindrical shape, having a disc-shaped base and a side wall extending vertically therefrom, forming a top rim and creating a hollow interior cavity;

a lid, consisting of a disc-shaped plate with a top side and a bottom side, with a U-shaped channel located on said bottom side and extending around the perimeter of said bottom side, a vacuum port, said vacuum port penetrating said lid and in fluid communication with said interior cavity of said canister, a suction port, said suction port penetrating said lid and in fluid communication with said interior cavity of said canister, a drain port, said drain port penetrating said lid and in fluid communication with said interior cavity of said canister, and a vacuum release port, said vacuum release port penetrating said lid and in fluid communication with said interior cavity of said canister;

a vacuum hose, consisting of a linearly elongated flexible tube, having a first end in fluid communication with a second end, said first end attached to a standard threaded hose fitting and said second end attached to a standard threaded hose fitting;

a suction hose, consisting of a linearly elongated flexible tube, having a third end in fluid communication with a fourth end, said third end attached to a standard threaded hose fitting and said fourth end attached to a standard threaded hose fitting; and a gauge manifold hose, consisting of a linearly elongated flexible tube, having a fifth end in fluid communication with a sixth end, said fifth end attached to a standard threaded hose fitting and said sixth end attached to a standard threaded hose fitting;

wherein said compressor oil recovery device is arranged in conjunction with a vacuum pump and a compressor such that, upon activating said vacuum pump, a vacuum is drawn, by said vacuum pump, through said vacuum hose, through said canister, through said suction hose, through said gauge manifold hose and into the compressor oil reservoir through said gauge manifold, thereby drawing said compressor oil through said gauge manifold hose and through said suction hose, depositing and collecting said compressor oil in said canister.

2. The compressor oil recovery device as described in claim 1, wherein said canister is constructed of a translucent material and includes graduation markings consisting of volumetrically delineating indicia along said canister used to indicate the volume of the fluid contained therein.

3. The compressor oil recovery device as described in claim 1, wherein said vacuum port comprises:

a first circular hole formed by said lid, said first circular hole penetrating between said top side of said lid to said bottom side of said lid;

a first hose connection, said first hose connection having a standard thread, affixed to said first circular hole, attached thereto and hermetically sealed; and a vacuum port sealing cap consisting of a threaded cap of a standard size so as to mate with and seal said first hose connection.

4. The compressor oil recovery device as described in claim 1, wherein said suction port comprises:

a second circular hole formed by said lid, said second circular hole penetrating between said top side of said lid to said bottom side of said lid;

a second hose connection, said second hose connection having a standard thread, affixed to said second circular hole, attached thereto and hermetically sealed; and a suction port sealing cap consisting of a threaded cap of a standard size so as to mate with and seal said second hose connection.

5. The compressor oil recovery device as described in claim 1, wherein said drain port comprises:

a third circular hole formed by said lid, said third circular hole penetrating between said top side of said lid to said bottom side of said lid;

a drain port sealing cap consisting of a threaded cap fitting connection of a standard size so as to mate with and hermetically seal said third circular hole.

6. The compressor oil recovery device as described in claim 1, wherein said vacuum release port comprises:

a fourth circular hole formed by said lid, said fourth circular hole penetrating between said top side of said lid to said bottom side of said lid;

a vacuum release port sealing cap consisting of a threaded cap fitting connection of a standard size so as to mate with and hermetically seal said fourth circular hole.

7. The compressor oil recovery device as described in claim 1, wherein said U-shaped channel on said bottom side of said lid is of a diameter such that said U-shaped channel coincides and mates with said top rim of said canister, and forms a friction fit hermetic seal between said canister and said lid when compressed thereon.

8. The compressor oil recovery device as described in claim 1, wherein said first end of said vacuum hose is connected to said vacuum port via said standard threaded hose connectors, forming a hermetic seal, and said third end of said suction hose is connected to said suction port via said standard threaded hose connectors, forming a hermetic seal.

9. The compressor oil recovery device as described in claim 1, wherein said fifth end of said gauge manifold hose is connected to the drain fitting on the gauge manifold of a compressor in a condensing unit via said standard threaded hose connectors, forming a hermetic seat, and said sixth end of said gauge manifold hose is connected to said fourth end of said suction hose via said standard threaded hose connectors, forming a hermetic seal.

10. The compressor oil recovery device as described in claim 1, wherein said second end of said vacuum hose is connected to said vacuum connection of a vacuum pump via said standard threaded hose connectors, forming a hermetic seal.

11. The compressor oil recovery device as described in claim 1, further comprising a float-type safety shut-off valve in fluid communication with said vacuum port which, when the compressor oil collected within said canister reaches a dangerous level, isolates said vacuum pump from said compressor oil recovery system, thus preventing said compressor oil from being drawn into said vacuum pump.

* * * * *